United States Patent [19]

Wallbaum

[11] 3,947,949

[45] Apr. 6, 1976

[54] METHOD OF MAKING DISPERSION HARDENED COPPER PRODUCTS

[75] Inventor: Hans-Joachim Wallbaum, Osnabruck, Germany

[73] Assignee: Kabel-und Metallwerke Gutehoffnungshutte AG, Hannover, Germany

[22] Filed: Apr. 23, 1975

[21] Appl. No.: 570,593

[52] U.S. Cl. ..... 29/420.5; 29/DIG. 47; 29/DIG. 31; 29/180 E; 29/191.2; 29/199; 29/197.5

[51] Int. Cl.[2] ..... B22F 3/24

[58] Field of Search.... 29/420.5, 420, 180 E, 191.2, 29/199, 197.5

[56] References Cited

UNITED STATES PATENTS

| | | | |
|---|---|---|---|
| 2,161,597 | 6/1939 | Swartz | 29/420 UX |
| 3,545,074 | 12/1970 | Foerster et al. | 29/420.5 |
| 3,595,710 | 7/1971 | Lambert et al. | 29/420.5 |

*Primary Examiner*—C. W. Lanham
*Assistant Examiner*—V. K. Rising
*Attorney, Agent, or Firm*—Ralf H. Siegemund

[57] ABSTRACT

Disks are cut from copper or a copper alloy which can be precipitation-hardened. A copper alloy powder is prepared and dispersion-hardened. The disks are assembled in a stack and alternate with powder layers and extruded. Subsequent heat treatment of the extruded product strengthens it throughout. The method is used specifically to make a hardened copper alloy to be used for making electrodes for resistance welding.

2 Claims, No Drawings

METHOD OF MAKING DISPERSION HARDENED COPPER PRODUCTS

BACKGROUND OF THE INVENTION

The present invention relates to a method of making semi-finished products and other objects using a material which has been strengthened by means of dispersion hardening.

Metallurgy and the physics of metals have taught the development of methods for controlling the properties of metal to be used as raw material for specific purposes. However, it is common knowledge that a change in one property affects other properties of the material, and an improvement of one is quite often accompanied by a deterioration of others. Thus, the balance of properties is often a compromise.

Take, for example, copper as a typical historical example. It has good thermal and electrical properties, but it is mechanically poor. Copper has been strengthened (already in ancient times), but the electrical and thermal properties deteriorate e.g. upon alloying. Of course, that depends to some extent on the method used for strengthening.

Metals have been strengthened e.g. hardened in various ways, such as by deformation of the structure during cold working, (strain hardening); strengthening by mixed crystall; precipitation hardening; strenthening by fiber reinforcement; and strengthening by means of dispersion, i.e. by causing dispersion and inclusion of particularly hard particles in the metal.

An essential function of either method is to impede any movement of dislocations in the crystal structure. Strengthening and hardening by dispersion operates on the principle that embedded particles (impurities) impede the migration and movement of dislocations in the crystal structure. These particles prevent such migration during deforming as well as during annealing at temperature above the recrystallization temperature. The impediment is so strong that even at temperatures up to 90 percent of the absolute melting point neither recrystallization nor a reduction of the tensile strength can be observed. Upon deforming (working) dislocations are stopped by the embedded particles and can pass only when the acting forces (stress) is greatly increased. The migration of grain boundaries is prevented in the same manner, even at very high temperatures so that growth of grains is, in fact, suppressed.

Strengthening of metal by means of dispersion hardening is considerably better than cold working or the mixed crystal method, because the strength is actually improved to a greater extent and the electrical properties e.g. of copper deteriorate to a lesser degree.

A disadvantage of the dispersion method is that e.g. oxygen requires a long time to diffuse into the solid copper. By way of example, sufficiently dense and homogenic internal oxidation in a copper-aluminum alloy requires periods for diffusion of the oxygen in the order of 100 hours per cm wall thickness and at temperatures of about 1000° C.

A paper published in "Metall", Vol. 24, of May 1970, issue No. 5, page 465, et seq. proposes dispersion hardening of thinner metal parts and compacting them subsequently.

DESCRIPTION OF THE INVENTION

It is an object of the present invention to improve the making of dispersion-hardened products having also improved ductility.

It is a specific object of the present invention to improve a method of strengthening material by dispersion hardening, in which strength enhencing inclusions are dispersed in a powder of the material.

In accordance with the preferred embodiment it is suggested to use dispersion-hardened metal powder and assemble a stack or pile of lamina as a blank, in which layers of powder alternate with punched disks of copper or a copper alloy, particularly of the variety that can be strengthened by precipitation hardening, if heated, cooled, and "aged". The stack or pile is placed into (or assembled in) a copper tube and extruded.

The powder consists preferably of a copper aluminum alloy, in which the aluminum content is about 0.5 to 1.5 percent and which has been dispersion-strengthened by exposure to an oxygen atmosphere. The disks are made of an alloy, in which copper is alloyed with 0.6 % chromium and 0.2 % zirconium (all percentages by weight).

The invention can be practiced in accordance with the following specific example. A copper aluminum alloy consisting of copper with 0.5 % aluminum was used to make a powder by any known method, such as atomizing the molten copper alloy under high pressure jets. That powder was heat-treated (annealed) in an oxidizing atmosphere, e.g. in air circulating furnace at 900° C for about one hour under normal pressure.

Separately from the foregoing, a 1 mm strip of copper to which had been alloyed 0.6 % chromium and 0.2 % zirconium was prepared through a known process e.g. by means of rolling. Disks were punched from this strip at a diameter of 270 mm. These disks are placed into a copper tube having about 3 mm wall thickness. However, these disks were stacked alternatingely with layers of the previously made and dispersion-strengthened powder.

It can readily be seen that the final consistency can be controlled through choice of the thickness of the powder layers. A like thickness of about 1 mm in each instance, i.e. between respective two copper alloy disks produces good result for the intended purpose, namely making electrodes for electric resistance welding.

The copper tube was then closed and any air was driven out at one end by flushing through protective gas (e.g. argon) from the other end. This tube being filled with copper alloy disks, powder and protective gas was then heated up to about 1000° C and extruded. During extrusion, the zirconium and chromium goes into solution in the copper. The rod emerging from the extrusion press die was passed through water for quenching. The rod was subsequently cut into convenient lengths and annealed for about one hour at temperatures between 400° and 550° C. This annealing serves as aging process during which solute atoms precipitate and strengthen and harden the copper. The final step was cold working the lengths to the desired shape and dimensions.

By means of the invention semi-finished products can be produced, which combine the strength properties of dispersion-hardened material with the properties of a precipitation-hardened material and/or of a pure metal, and the ductility is improved, e.g. increased; i.e. the hardening process does not or only very little increase brittleness.

The specific method outlined above can be used to make electrodes for electrical resistance welding consisting of a dispersion-strengthened copper alloy and a precipitation-strengthened copper alloy. These electrodes have particularly mechanical strength at low temperatures on account of the precipitation-hardened copper-chromium-zirconium alloy. However, the strength is reduced very little with rising temperatures, and that is the specific advantage and attributable to the dispersion-hardened portion. Moreover, the dispersed particles reduce electrical and conductivities of the alloy very little which, of course, is beneficial in that electrical currents produce little heating and whatever heat is developed.

The invention is not limited to the embodiments described above, but all changes and modifications thereof not constituting departures from the spirit and scope of the invention are intended to be included.

I claim:

1. In a method for making semi-finished products of dispersion-strengthened copper alloys, wherein a powder is made of a dispersion-hardened copper alloy, the improvement of providing a blank in which disks of copper or a copper alloy alternate with layers of said powder inside of a copper tube and extruding the blank to obtain and extrude semi-finished products.

2. In a method as in claim 1 and including the steps of removing the air from the tube and replacing it by a protective gas prior to extruding.

* * * * *